US007272968B2

(12) United States Patent
Maruo et al.

(10) Patent No.: US 7,272,968 B2
(45) Date of Patent: Sep. 25, 2007

(54) DEVICE FOR SHAPING CORRUGATED FIN

(75) Inventors: Shizuo Maruo, Okazaki (JP); Yukinori Hatano, Okazaki (JP); Fumiaki Nakamura, Kariya (JP); Haruo Nagai, Nukata-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/414,258

(22) Filed: May 1, 2006

(65) Prior Publication Data

US 2006/0254334 A1 Nov. 16, 2006

(30) Foreign Application Priority Data

May 10, 2005 (JP) ..... 2005-137684

(51) Int. Cl.
*B21D 13/00* (2006.01)

(52) U.S. Cl. ..... 72/385; 72/379.6; 72/180; 72/184

(58) Field of Classification Search ..... 72/385, 72/408, 411, 418, 379.6, 180, 370.19
See application file for complete search history.

(56) References Cited

U.S. PATENT DOCUMENTS 3,670,781 A * 6/1972 Liouville ..... 140/71 R
3,724,538 A * 4/1973 Yamaguchi et al. ..... 165/152
3,850,018 A * 11/1974 Drosnin ..... 72/186
4,523,500 A * 6/1985 Maruyama ..... 83/37
5,176,020 A * 1/1993 Maruo et al. ..... 72/186
5,819,575 A * 10/1998 Kobayashi et al. ..... 72/187
6,430,983 B1 * 8/2002 Nozaki et al. ..... 72/186

FOREIGN PATENT DOCUMENTS

JP 58055118 A * 4/1983
JP 60234724 A * 11/1985
JP 04172139 A * 6/1992
JP A 08-261678 10/1996

* cited by examiner

*Primary Examiner*—Dmitry Suhol
(74) *Attorney, Agent, or Firm*—Oliff & Berridge, PLC

(57) ABSTRACT

The configuration comprises a shaping member 3 having a substantially rectangular shape and shaping the inner surface side of a bent portion 1*b*, a worm gear 2 slidably linked with the shaping member 3 and gradually reducing the distance between the shaping members 3 for sequentially feeding the shaping member 3 from one side to the other side, and a reference member 4 arranged so that the upper end surface of the bent portion 1*b* comes into contact with its reference surface, and the distance between the shaping members 3 is gradually reduced to a predetermined fin pitch and the upper end surface of the bent portion 1*b* is shaped into a predetermined shape by rotating the worm gear 2 after the plurality of bent portions 1*b* are arranged at the shaping members 3. Due to this, it is possible to shape the bent portion into a continuous and stable shape.

7 Claims, 4 Drawing Sheets

DEVICE FOR SHAPING CORRUGATED FIN

BACKGROUND OF THE INVENTION

1. Technical Field of the Invention

The present invention relates to a device for shaping a corrugated fin into a wave shape with its bent portions successively connected and, more particularly, to shaping a bent portion.

2. Description of the Related Art

In a conventional device for shaping a corrugated fin of this type, for example, the one described in Japanese Unexamined Patent Publication (Kokai) No. H08-261678, by feeding a fin material between a pair of gear-like forming rollers from a material roll around which a thin plate-like fin material is wound, a number of bent portions are formed and a corrugated fin is formed into a wave shape and, at the same time, a heat exchange section for promoting heat exchange is formed on a surface continuous with the bent portion and thus a wave-shaped corrugated fin is formed.

Further, a forming device is known which continuously performs shaping in order to obtain a predetermined shape and a predetermined fin pitch by performing a compression process for compressing a wave-shaped corrugated fin formed by being passed through a forming roller in its lengthwise direction and a stretch process for stretching the compressed fin material by a predetermined distance in its lengthwise direction while holding both ends.

However, in the compression process for performing shaping as described in Japanese Unexamined Patent Publication (Kokai) No. H08-261678, the known forming device is made so as to include a feeding roller for feeding forward a wave-shaped corrugated fin and a friction application section for applying a frictional resistance to the corrugated fin to be fed, and the corrugated fin is compressed in its lengthwise direction by compressing it so that a number of bent portions come into contact with each another at one time.

Because of this, it is not possible to apply a uniform compression force to each ridge and, therefore, there may be a case where the amount of displacement of a portion to which a strong compression force is applied or of a portion vulnerable to bending force becomes large and in particular, a collapse begins from a bent portion with a small strength, resulting in that the shape of the bent portion is not formed into a predetermined shape.

In particular, if a bent portion is required to have, for example, a portal shape, it is difficult to obtain a predetermined shape that meets a required precision regarding the irregularity or inclination of the planar portion. Further, it is recommended to provide a shaping device capable of shaping a planar portion by providing a shaping mechanism inside and outside a bent portion for each ridge after compression formation in order to shape the planar portion into a stable shape, however, there arises a problem in that a complex shaping device is required and the facility cost for the device is increased.

SUMMARY OF THE INVENTION

An object of the present invention is, the above-mentioned problem being taken into account, to provide a corrugated fin shaping device capable of shaping the planar shape of a folding portion into a continuous and stable shape.

In order to attain the above-mentioned object, the technical means described below is employed. In other words, in the present invention, a corrugated fin shaping device for shaping a corrugated fin (1) having a plurality of bent portions (1*b*) formed as a flat top portion comprises a plurality of shaping members (3) provided in accordance with the bent portions (1*b*) of the corrugated fin (1) and shaping the bent portion while holding the inner surface side of the bent portion (1*b*) by its top end portion, a feeding mechanism slidably linked with the plurality of shaping members (3) and sequentially feeding the shaping members (3) from one side to the other side so as to gradually reduce the distance between the shaping members (3), and a reference member (4) having a reference surface with which the upper end surface of the bent portion (1*b*) in opposition to the inner surface side of the bent portion (1*b*) comes into contact, wherein the feeding mechanism (2) gradually reduces the distance between the shaping members (3) to a predetermined fin pitch and shapes the upper end surface of the bent portion (1*b*) into a predetermined shape in a state in which the plurality of bent portions (1*b*) of the corrugated fin (1) are arranged at the respective shaping members (3).

According to the present invention, it is possible to shape the bent portion (1*b*) into a predetermined planar shape, to have a predetermined fin pitch, because a uniform compression force is applied to the respective bent portions (1*b*) due to the feeding mechanism (2) and the shaping members (3).

Further, in the corrugated fin (1), the bent portion (1*b*) is a contact portion that comes into contact with a heat transfer medium and it is possible to improve the heat transferability of the corrugated fin (1) because the contact area of the contact portion can be increased and, at the same time, it can be shaped into a stable shape.

In the present invention, the feeding mechanism (2) is formed by a worm-like groove that rotates and the groove slidably comes into contact with each of the shaping members (3) at least at two positions in order to maintain the plurality of shaping members in the direction perpendicular to the direction in which they are fed from one side to the other side.

According to the present invention, it is possible to gradually move the plurality of shaping members (3) with ease from one side to the other side by means of the worm-like groove and to form a shaping device with a simple structure. Further, it is also possible to shape the bent portion (1*b*) into a stable shape.

The symbols in the brackets attached to each means described above indicate a correspondence with a specific means in the embodiments to be described later.

The present invention may be more fully understood from the description of preferred embodiments of the invention, as set forth below, together with the accompanying drawings.

DESCRIPTION OF THE PREFERRED EMBODIMENTS

Figure 1:
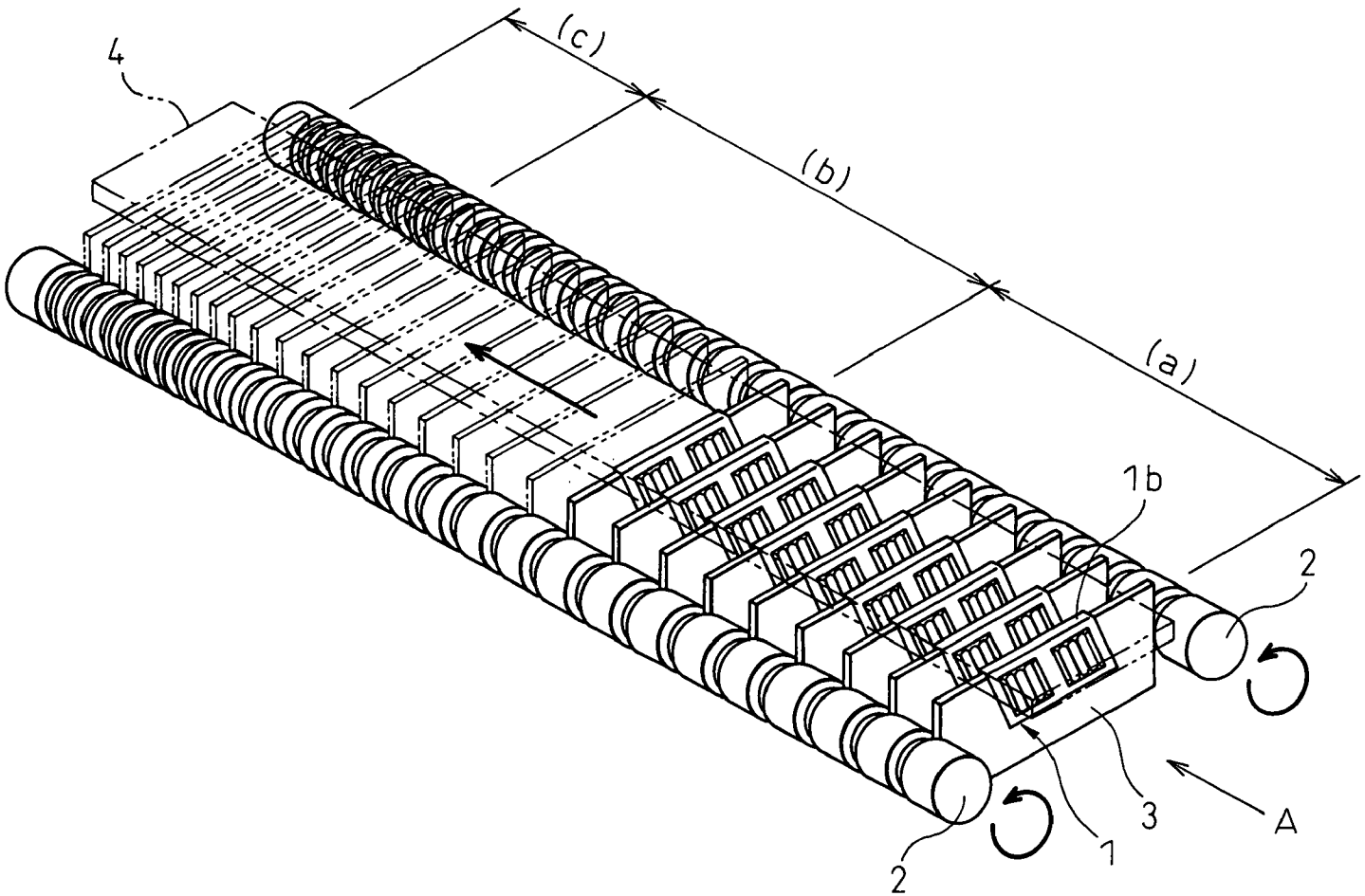
FIG. 1 is a schematic diagram showing the entire configuration of a corrugated fin shaping device in an embodiment of the present invention.
Figure 2B:
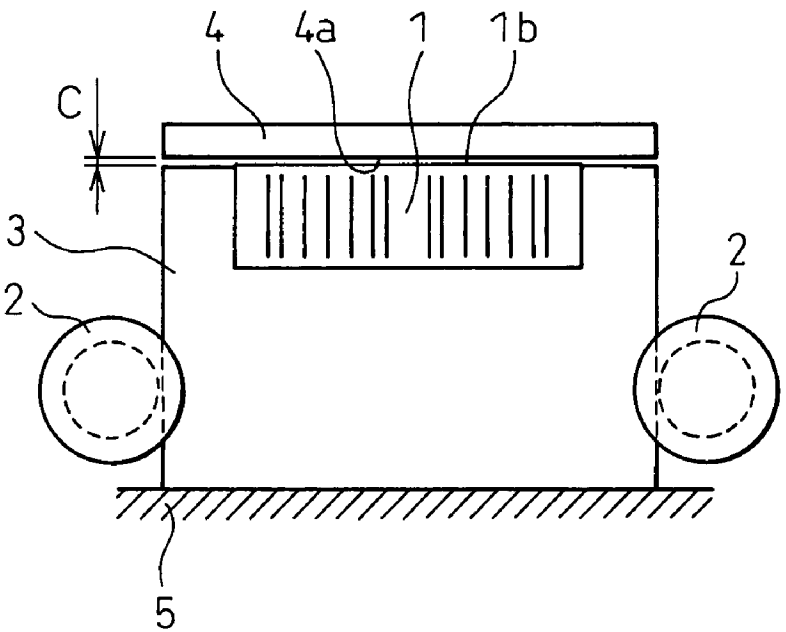
FIG. 2B is a diagram when viewed in the direction of the arrow A in FIG. 1.
Figure 2A:
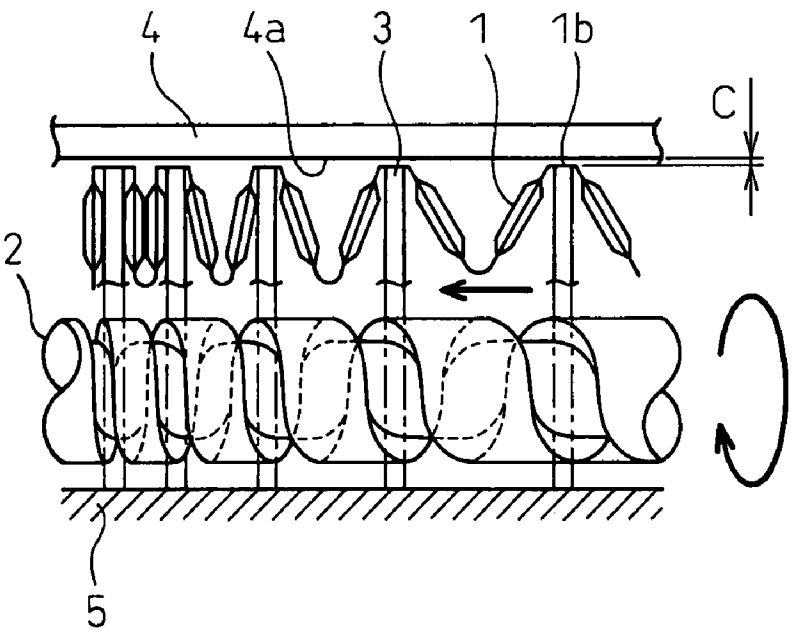
FIG. 2A is a schematic diagram showing shaping a corrugated fin 1 in an embodiment of the present invention.

A corrugated fin shaping device in an embodiment of the present invention is explained below with reference to FIG. 1 to FIG. 4. FIG. 1 a schematic diagram showing the entire configuration of the corrugated fin shaping device in the present embodiment. FIG. 2A is a schematic diagram showing a shaping method of a corrugated fin 1 and FIG. 2B is a diagram when viewed in the direction of the arrow A in FIG. 1.

Figure 3:
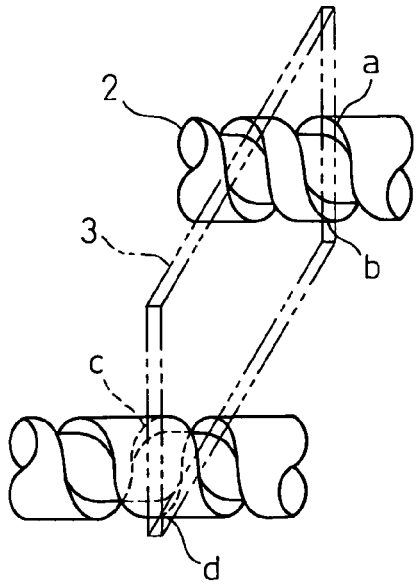
FIG. 3 is a diagram for explaining a state in which a shaping member 3 and a worm gear 2, which is a feeding mechanism, are arranged in an embodiment of the present invention.
Figure 4A:
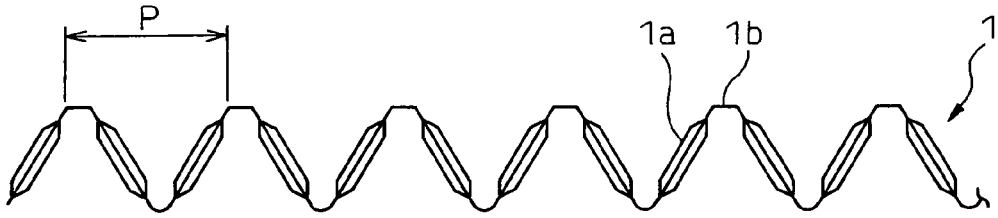
FIG. 4A is an external view showing an external shape of the corrugated fin 1 before shaping work.

FIG. 3 is a diagram for explaining a state in which a shaping member 3 and a worm gear 2, which is a feeding mechanism, are arranged. FIG. 4A is an external view showing an external shape of the corrugated fin 1 before shaping work and FIG. 4B is a external view showing an external shape of the corrugated fin 1 after shaping work.

Figure 4B:
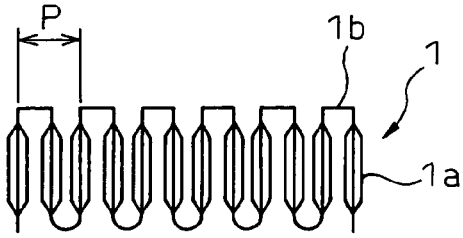
FIG. 4B is a external view showing an external shape of the corrugated fin 1 after shaping work.

The corrugated fin shaping device in the present embodiment is a device for shaping the corrugated fin 1 before shaping work, shown in FIG. 4A, into the corrugated fin 1 with the shape shown in FIG. 4B, and reducing the corrugated fin 1 formed into a wave-shape by a forming roller or a forming press, which is a separate forming device, so as to have a predetermined fin pitch P and shaping the upper end portion of a bent portion 1*b* on the ridge side into a planar shape.

Here, as shown in FIG. 4A, the corrugated fin 1 before shaping is formed into a wave-shape by successively connecting the planar bent portion 1*b* and a louver-like heat exchange section 1*a* for promoting heat exchange on a surface continuous with the bent portion 1*b* on a thin plate. Specifically, the corrugated fin 1 is formed so that the entire shape thereof has an upside down V shape in a state in which the fin pitch P is greater than a predetermined pitch.

As shown in FIG. 1 to FIG. 3, the corrugated fin shaping device comprises the plurality of shaping members 3 provided in accordance with the plurality of bent portions 1*b*, the worm gear, which is a feeding mechanism for sequentially feeding the plurality of shaping members 3 from one side to the other side, a reference member 4 arranged so that the upper end surface of the bent portion 1*b* comes into contact with a reference surface, and an inclination prevention plate 5.

The shaping member 3 is a plate member for shaping the inner surface side of the bent portion 1*b* as well as holding the corrugated fin 1, having a substantially rectangular section, and arranged at the respective bent portions 1*b* so as to hold the inner surface side of the bent portion 1*b*, which is the ridge side of the corrugated fin 1, with its top end portion, as shown in FIG. 1 and FIG. 2A.

The worm gear 2 is a screw arranged on each end of the shaping member 3 so as to be capable of sliding the plurality of shaping members 3 with at least two worm gears 2 via grooves, and worm-like grooves are formed so as to gradually reduce the distance of the sequential feeding of the plurality of shaping members 3 from one side to the other side by rotating the worm gear 2.

More specifically, the grooves and the groove pitch are formed so that the distance of sequential feeding has three patterns, that is, (a), (b), and (c) shown in FIG. 1. In other words, (a) corresponds to a fin mount portion for arranging the corrugated fin 1 before shaping, where the worm-like grooves are formed so that the fin pitch P, which is the distance between the shaping members 3, is large. At this time, the fin pitch P is the fin pitch P of the corrugated fin 1 formed by a forming device.

Further, (b) corresponds to a fin pitch reduction portion, where the worm-like grooves are formed, which gradually reduce the fin pitch p, that is, the distance between the shaping members 3. Furthermore, (c) corresponds to a shaping completion portion at which a predetermined fin pitch P is attained, where the worm-like grooves capable of attaining a predetermined fin pitch P are formed.

As shown in FIG. 3, groove widths are provided in these grooves so that the plurality of shaping members 3 maintain their vertical posture with respect to the vertical direction by means of four points a to d that hold the shaping member 3.

The inclination prevention plate 5 is a holding plate for holding the shaping member 3 with the grooves of the worm gear 2 as well as preventing the top end of the shaping member 3 from inclining when the shaping member 3 is fed and, similar to the groove, serves as a support for holding the shaping member 3 so as to maintain its posture with respect to the vertical direction.

On the other hand, reference member 4 is a reference surface 4*a* with which the upper end surface of the bent portion 1*b* of the corrugated fin 1 comes into contact when the shaping member 3 is fed from one side to the other side and, after the corrugated fin 1 is arranged on the fin mount portion denoted by (a) shown in FIG. 1, is fixed in a state in which an extremely small gap C is reserved above the shaping member 3, as shown in FIG. 2.

In other words, it is arranged so that the upper end surface of the bent portion 1*b* comes into contact with the reference surface 4*a* when the shaping member 3 is fed in the direction of the arrow as shown in FIG. 2A. Due to this, the upper end surface of the bent portion 1*b* is shaped into a planar shape even if there is deformation such as bumps and dips thereon.

Next, a shaping method of a corrugated fin shaping device with the above-mentioned configuration is explained based on FIG. 1 and FIG. 2. First, as shown in FIG. 1, the corrugated fin 1 formed by a forming device is arranged so that the bent portion 1*b* of the corrugated fin 1 is arranged on each of the shaping members 3. Then, the reference member 4 is fixed so that the reference surface 4*a* is located at a predetermined position above the bent portion 1*b* of the corrugated fin 1.

Then, the worm gear 2 is rotated. Due to this, the plurality of shaping members 3 are fed in the direction of the arrow. Due to this, the gap between the shaping members 3 is gradually reduced as shown in FIG. 2A and finally, the gap between the shaping members 3 is reduced to the minimum fin pitch, that is, the predetermined fin pitch P.

At this time, a uniform compression force is applied to each of the bent portions 1*b* due to the worm gear 2 and the shaping member 3, therefore, the upper end surface of the bent portion 1*b* comes into contact with the reference surface 4*a* and is shaped into a planar shape. Due to this, it is possible to shape the upper end surface of the bent portion 1*b* with high precision. Then, after all of the bent portions 1*b* are shaped into the predetermined fin pitch P and the corrugated fin 1 is removed, by reversing the worm gear 2, the plurality of shaping members 3 can be returned to the original position.

By the way, for the corrugated fin 1 after shaping, it is possible to improve heat transferability because the planar bent portion 1*b* is a contact portion that comes into contact with a heat transfer medium and the contact area of the contact portion can be increased and therefore the contact portion can be shaped-into a stable shape.

According to the corrugated fin shaping device in the above-mentioned one embodiment, the worm gear 2 is configured so that after the plurality of bent portions 1*b* are arranged at the respective shaping members 3, by rotating the worm gear 2, the distance between the shaping members 3 is gradually reduced to the predetermined pitch and the upper end surface of the bent portion 1*b* is shaped into the predetermined shape.

According to this, it is possible to shape the bent portion 1*b* into a predetermined planar shape, so as to have a predetermined fin pitch, because a uniform compression force is applied to the bent portion 1*b* due to the worm gear 2 and the shaping member 3.

Further, for the corrugated fin 1 after shaping, it is possible to improve heat transferability because the bent portion 1*b* is a contact portion that comes into contact with a heat transfer medium and the contact area of the contact portion can be increased and the contact portion can be shaped into a stable shape The worm gear 2 is formed by worm-like grooves and, in order to maintain the shaping member 3 in the vertical direction, is arranged so as to be capable of slidably coming into contact with the shaping member at least at two positions, therefore, it is possible to gradually move the plurality of shaping members 3, with ease, from one side to the other side by means of the worm-like grooves and to form a shaping device with a simple structure. Further, it is also possible to shape the shape of the bent portion 1*b* into a stable shape successively

OTHER EMBODIMENTS

Figure 5B:
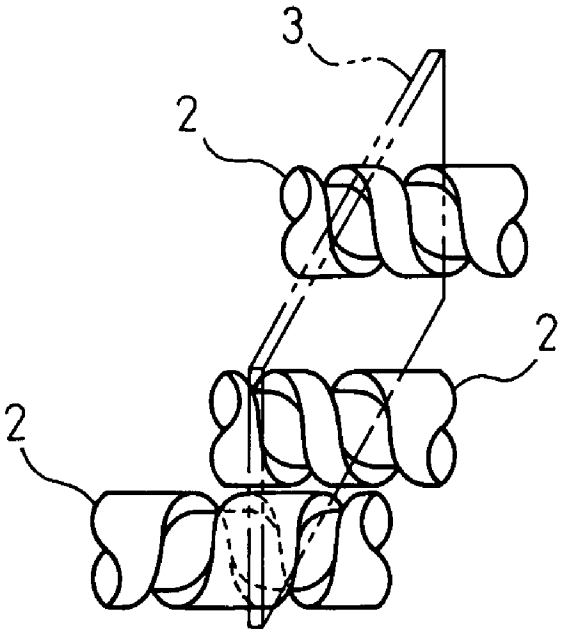
FIG. 5A and FIG. 5B are schematic diagrams showing the entire configuration of a corrugated fin shaping device in another embodiment.
Figure 5A:
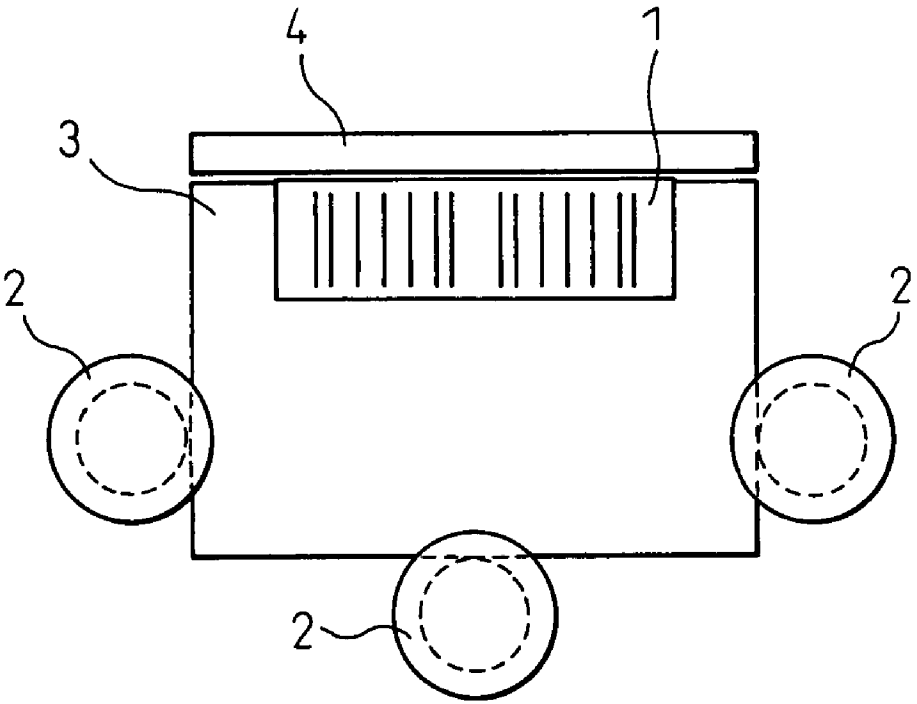

In the above-mentioned one embodiment, the configuration is made by the two worm gears 2 and the inclination prevention plate 5 in order to maintain the vertical posture of the plurality of shaping members 3 with respect to the vertical direction, however, this is not limited, and specifically, as shown in FIG. 5A and FIG. 5B, it may also be possible to provide another worm gear 2 under the shaping member 3 instead of the inclination prevention plate 5.

According to this, it is possible to maintain the plurality of shaping members 3 in a well-balanced manner, and to easily prevent the top end from inclining, with a simple configuration.

In the above-mentioned embodiments, the present invention is applied to a corrugated fin. However, generally, the present invention can be effectively used to shape the planar bent portion 1*b* of a corrugated fin of a heat exchanger such as an evaporator, a condenser, a radiator, and a heat core radiator.

In addition to such a use, the present invention can be applied to a heat exchange device that uses a Peltier element and which effects heat exchange for heat absorption and heat dissipation. According to this, it is possible to improve the performance of thermoelectric conversion efficiency by improving the heat transferability of the Peltier element While the invention has been described by reference to specific embodiments chosen for purpose of illustration, it should be apparent that numerous modifications could be made thereto, by those skilled in the art, without departing from the basic concept and scope of the invention.

The invention claimed is:

1. A corrugated fin shaping device for shaping a corrugated fin having a plurality of bent portions formed as a flat top portion, comprising:

a plurality of shaping members provided in accordance with the bent portions of the corrugated fin and shaping the bent portion while holding the inner surface side of the bent portion by its top end portion;

a feeding mechanism slidably linked with the plurality of shaping members and sequentially feeding the shaping members from one side to the other side so as to gradually reduce the distance between the shaping members; and a reference member having a reference surface with which the upper end surface of the bent portion in opposition to the inner surface side of the bent portion comes into contact, wherein:

the feeding mechanism gradually reduces the distance between the shaping members to a predetermined fin pitch and shapes the upper end surface of the bent portion into a predetermined shape in a state in which the plurality of bent portions of the corrugated fin are arranged at the respective shaping members.

2. The corrugated fin shaping mechanism as set forth in claim 1, wherein the feeding mechanism is formed by worm-like grooves that rotate and the grooves slidably come into contact with each of the shaping members at least at two positions so as to maintain the plurality of shaping members in the direction perpendicular to the direction in which the shaping members are fed from one side to the other side.

3. The corrugated fin shaping device as set forth in claim 2, wherein the corrugated fin, before shaping, has a fin pitch P before shaping greater than the predetermined fin pitch and is formed into a shape in which the plurality of bent portions and a plurality of louver-like heat exchange portions provided on a surface continuous with the bent portion are successively connected and the fin portions having a V shape continue in a waved manner.

4. The corrugated fin shaping device as set forth in claim 3, wherein:

the feeding mechanism is formed by a pair of worm gears arranged in opposition to each other on both ends of the shaping member and slidably holds the plurality of shaping members via the worm-like grooves of the worm gear and sequentially feeds the plurality of shaping members from one side to the other side by rotating the worm gears so that the distance of the sequential feeding is gradually reduced and groove pitches of the groove are formed so as to have first to third patterns;

the first pattern has a first distance corresponding to the distance between the shaping members on which the corrugated fin having the fin pitch P before shaping is mounted;

the second pattern has a second distance corresponding to a fin pitch gradually reduced from the fin pitch P before shaping;

the third pattern has a third distance corresponding to the predetermined fin pitch P after shaping is completed; and in the grooves of the worm gear, groove widths are provided so as to hold the shaping member at four points so that the posture of the plurality of shaping members can be maintained perpendicular.

5. The corrugated fin shaping device as set forth in claim 4, wherein the reference member constitutes a reference surface that comes into contact with the upper end surface of the bent portion 1*b* of the corrugated fin when the shaping member is fed from one side to the other side and when the corrugated fin is arranged at the shaping members having the first pattern distance, which is arranged in a state in which an extremely small gap C is reserved in between with the shaping member.

6. The corrugated fin shaping device as set forth in claim 4, wherein the feeding mechanism returns the plurality of shaping members to the position corresponding to the first distance by rotating the worm gears in the reverse direction in a state in which the corrugated fin, after shaping, is removed from the shaping members.

7. The corrugated fin shaping device as set forth in claim 2, further comprising an inclination prevention plate, wherein the inclination prevention plate faces the reference member with the shaping member in between and prevents the top end of the shaping member from inclining when the shaping members are fed from one end to the other end and constitutes a holding plate for holding the shaping member with the worm-like grooves.

* * * * *